US006753747B2

(12) United States Patent
Ma

(10) Patent No.: US 6,753,747 B2
(45) Date of Patent: Jun. 22, 2004

(54) INTEGRATED MICROSPRINGS FOR HIGH SPEED SWITCHES

(75) Inventor: Qing Ma, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 95 days.

(21) Appl. No.: 10/113,718

(22) Filed: Apr. 1, 2002

(65) Prior Publication Data

US 2003/0184419 A1 Oct. 2, 2003

(51) Int. Cl.[7] ..... H01H 51/22
(52) U.S. Cl. ..... 335/83; 200/181
(58) Field of Search ..... 335/78–86; 200/181; 257/414, 417, 421–424

(56) References Cited

U.S. PATENT DOCUMENTS 5,690,498 A * 11/1997 Sobhani ..... 439/22
5,744,766 A * 4/1998 Sambar et al. ..... 200/243
6,124,650 A * 9/2000 Bishop et al. ..... 335/79

* cited by examiner

*Primary Examiner*—Lincoln Donovan
(74) *Attorney, Agent, or Firm*—Trop, Pruner & Hu, P.C.

(57) ABSTRACT

An integrated microspring switch may be provided for relatively high frequency switching applications. A spring arm may be formed over a microspring dimple, which may be hemispherical and hollow in one embodiment. When the spring arm contacts the dimple, the spring dimple may resiliently deflect away or collapse, increasing the contact area between the spring arm and the dimple.

9 Claims, 5 Drawing Sheets

INTEGRATED MICROSPRINGS FOR HIGH SPEED SWITCHES

BACKGROUND

This invention relates generally to switches for high speed circuits such as radio frequency switches.

In switches that operate at high speed, it is important that the switch itself does not unduly degrade the signal being switched. Insertion loss is a measure of signal degradation caused by a switch. Insertion loss is dominated by the dimple contact resistance. Generally, a cantilevered switch arm includes a dimple or hemispherical portion near its free or moving end which contacts a contact pad on a fixed structure.

To reduce the resistance in contact, soft metals are used for the dimples and large contact forces are often necessary to increase real contact area. Soft metals and large contact forces result in faster contact wear. As the contact wears, the reliability of the switch may be adversely affected.

Thus, there is a need for better ways to make switches for high speed circuits.

DETAILED DESCRIPTION

Figure 1:
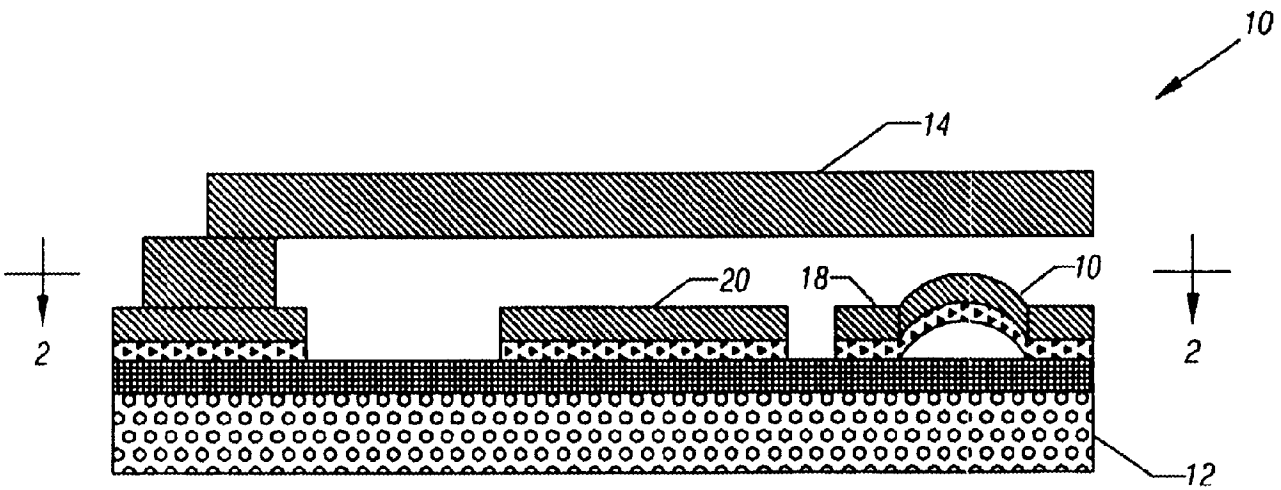
FIG. 1 is a greatly enlarged cross-sectional view of one embodiment of the present invention.

Referring to FIG. 1, an integrated microelectromechanical system (MEMS) switch 10 for a high speed circuit, such as a radio frequency circuit, includes a semiconductor structure 12 coupled to a contact arm 14. In one embodiment of the present invention, the contact arm 14 is a cantilevered contact arm. The free end of the contact arm 14 contacts a microspring dimple 16 positioned on the structure 12. The actuation or movement of the arm 14 may be under control of a plate 20 which applies an electrical force to the arm 14 to attract it towards the structure 12 one embodiment of the present invention.

Figure 2:
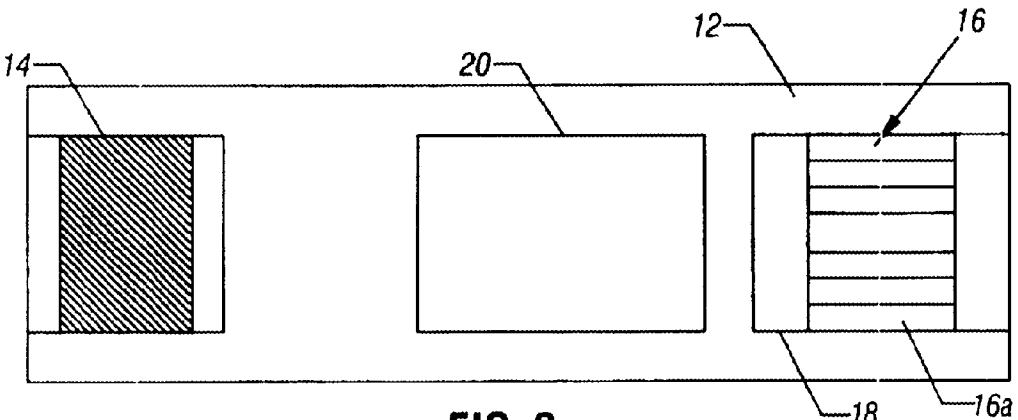
FIG. 2 is a cross-sectional view taken generally along the line of 2—2 in FIG. 1.

As shown in FIG. 2, the microspring dimple 16 may include a plurality of spaced hemispherical strips 16*a* which extend between contact areas 18 for electrical connection to the remainder of the controlled circuit. In some embodiments, the microspring dimple strips 16*a* may be made of relatively stiff material that is resilient so that it is possible to have a large contact area between the arm 14 and the dimple 16 without using particularly soft metals or large contact forces.

When the spring arm 14 is deflected by the plate 20 to contact the strips 16*a*, the strips 16*a* may deflect or collapse resiliently, increasing the contact area with the spring arm 14. Therefore, the microspring dimple 16 may achieve low contact resistance and superior contact reliability in some embodiments.

Figure 3:
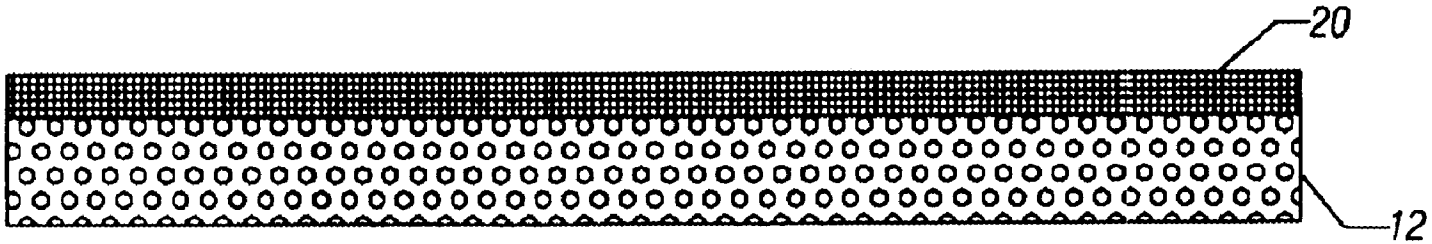
FIG. 3 is an enlarged cross-sectional view at an early stage of manufacturing for the structure shown in FIGS. 1 and 2 in accordance with one embodiment of the present invention.

In accordance with one embodiment of the present invention, the structure shown in FIGS. 1 and 2 may be manufactured from a semiconductor structure 12 having a dielectric layer 20 formed thereon as shown in FIG. 3. The dielectric layer 20 may be, for example, silicon nitride. The dielectric layer 20 isolates the conductive material utilized for the microspring dimple 16 from the semiconductor structure 12.

Figure 4:
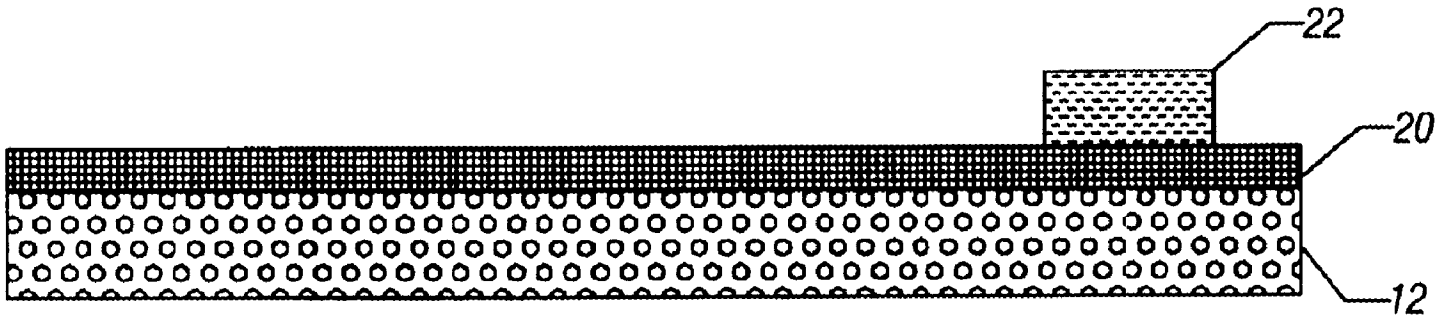
FIG. 4 is an enlarged cross-sectional view at a subsequent stage in accordance with one embodiment of the present invention.
Figure 5:
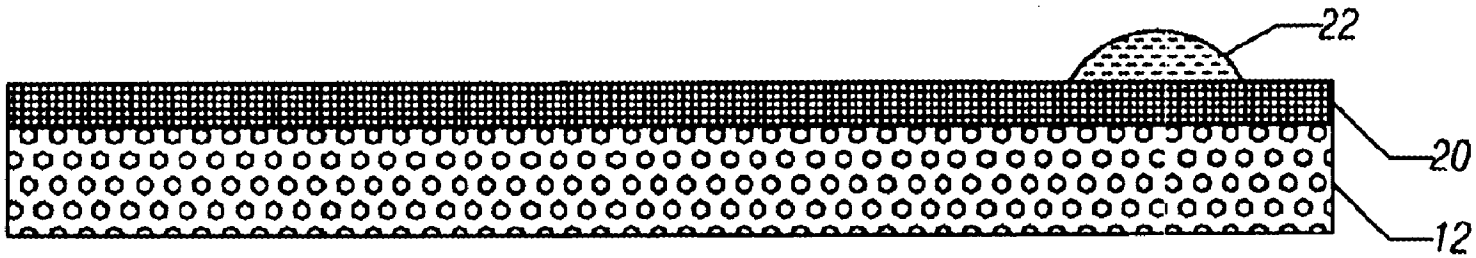
FIG. 5 is an enlarged cross-sectional view at a subsequent stage in accordance with one embodiment of the present invention.

Moving to FIG. 4, a reflow layer 22 may be deposited and patterned. The reflow layer may be made of polymeric materials, such as polyimide, resist, or flowable glasses, to mention a few examples. As shown in FIG. 5, the layer 22 may be reflowed at an elevated temperature to assume a hemispherical shape.

Figure 6:
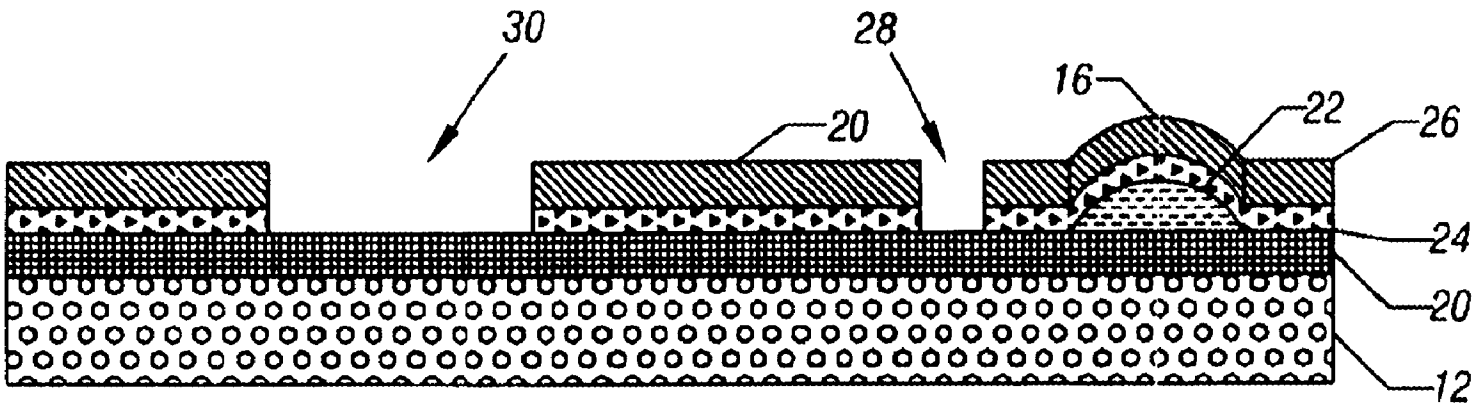
FIG. 6 is an enlarged cross-sectional view at a subsequent stage in accordance with one embodiment of the present invention.

Referring to FIG. 6, a conductive layer may be formed over the structure shown in FIG. 5. The conductive layer may be metal in one embodiment or may be a composite of two layers 24 and 26 in another embodiment. The top layer 26 may be optimized for contact resistance and the bottom layer 24 may be optimized for controlling spring compliance. Thus, the top layer 26 may be conductive and may be formed of a metal in one embodiment while the bottom layer 24 may be formed of a metal or a dielectric in some embodiments.

A plurality of openings 28 and 30 may be patterned in the layers 24 and 26 to ultimately form the actuator plate 20 and the microspring dimple 16. Because of the imposition of the reflowed layer 22, the microspring 16 takes on a hemispherical shape.

Figure 7:
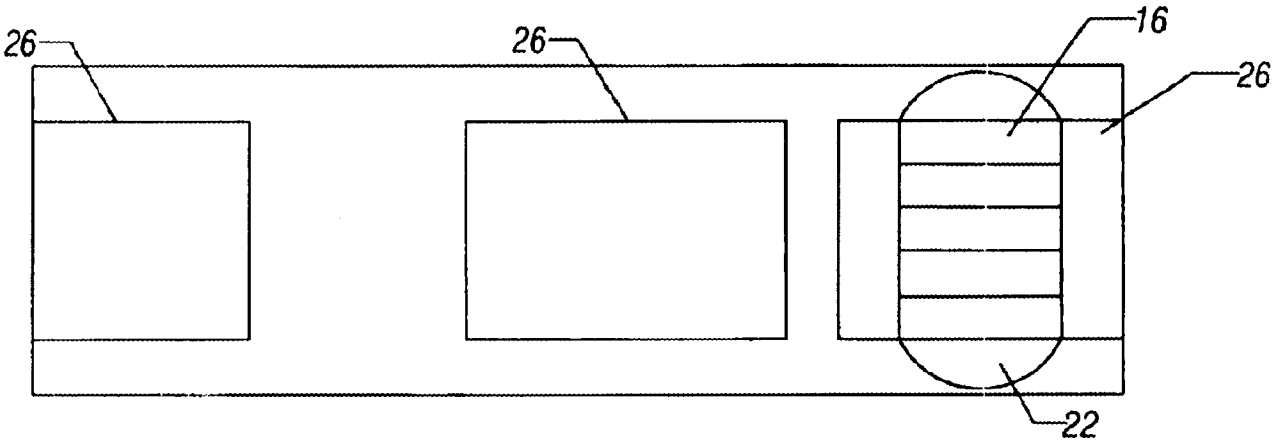
FIG. 7 is a top plan view of the structure shown in FIG. 6 in accordance with one embodiment of the present invention.

As shown in FIG. 7, a plurality of curved strips 16*a* may make up the microspring dimple 16 in one embodiment of the present invention. Each of the strips 16*a* may be formed integrally with surrounding contact areas 18 that may electrically couple other electrical components. Also formed as a result of the steps shown in FIG. 6, is the base 26 for the spring arm 14 and the actuator plate 20.

Figure 8:
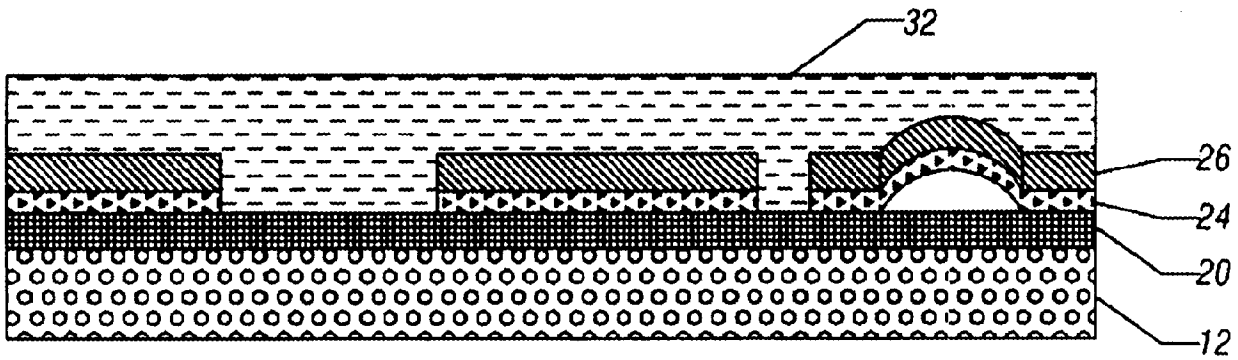
FIG. 8 is an enlarged cross-sectional view at a subsequent stage of manufacturing in accordance with one embodiment of the present invention.

As shown in FIG. 8, a release layer 32 may be deposited over the structure shown in FIG. 7 in one embodiment of present invention, and the resulting layer may be planarized. In one embodiment, the layer 32 may be formed of the same material as the layer 22. Planarization can be done in a variety of ways, including using reflow.

Figure 9:
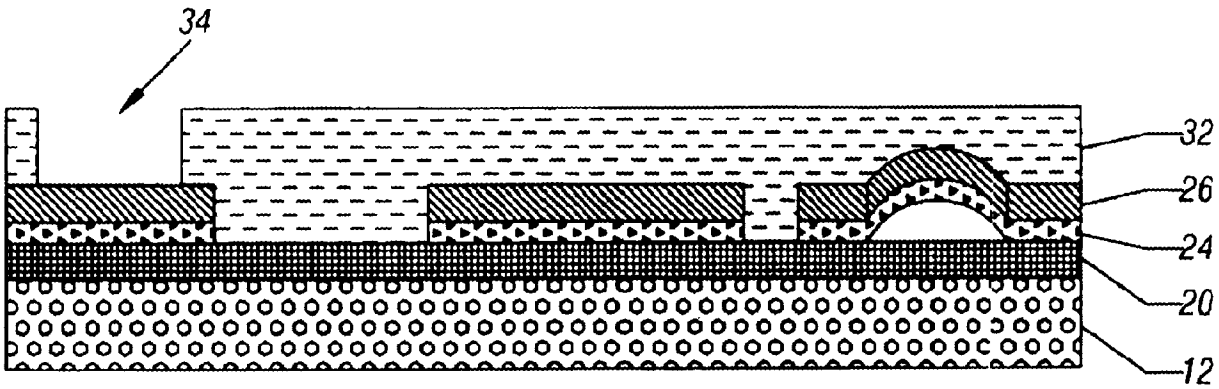
FIG. 9 is an enlarged cross-sectional view at a subsequent stage of manufacturing in accordance with one embodiment of the present invention.
Figure 10:
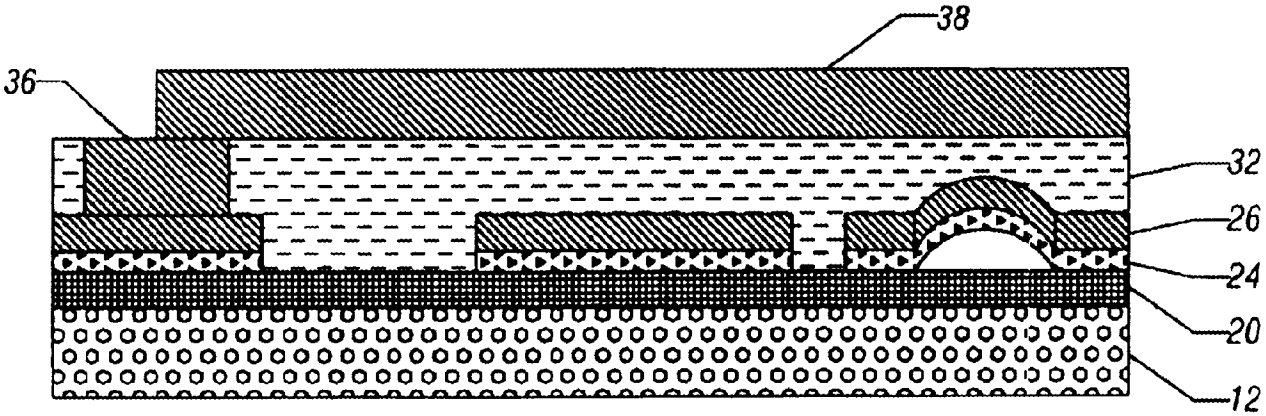
FIG. 10 is an enlarged cross-sectional view at a subsequent stage of manufacturing in accordance with one embodiment of the present invention.

As shown in FIG. 9, a hole 34 may be formed over the layer 26. As shown in FIG. 10, an anchor 36 may be deposited in the hole 34. The anchor 36 may be made of a conductive material such as metal. A layer 38 of the spring arm 14 may then be formed, for example, by depositing a resilient metal and patterning the deposited metal.

The release layer 32 is then removed, for example, by heating in accordance with one embodiment of the present invention, resulting in the structure shown in FIG. 1. The portion of the release layer 32 underneath the dimple 16, as well as the material between the spring arm 14 and the structure 12, is also removed. In some embodiments, the heated release material simply passes as a gas through the gaps between the spring arm strips 16*a*.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A switch comprising:

a semiconductor structure;

a curved collapsible microspring formed on said semiconductor structure; and a spring arm formed on said semiconductor structure including a pair of opposed ends, one of said ends coupled to said semiconductor structure and the other said ends positioned over said microspring.

2. The switch of claim 1 including an actuator formed on said semiconductor structure to move said spring arm towards and away from said microspring.

3. The switch of claim 2 wherein said spring arm has first and second ends and said actuator is formed between the first and second ends of said spring arm.

4. The switch of claim 1 wherein said microspring is hemispherical.

5. The switch of claim 1 wherein said microspring is formed of a plurality of spaced, curved strips.

6. The switch of claim 5 wherein each of said strips contacts said semiconductor structure at two spaced points.

7. The switch of claim 1 wherein said spring arm and said microspring are resilient.

8. The switch of claim 1 wherein said switch is a microelectromechanical system.

9. The switch of claim 1 wherein said microspring is resilient.

* * * * *